US005632094A

United States Patent [19]

Mills

[11] Patent Number: 5,632,094

[45] Date of Patent: May 27, 1997

[54] ARTICULATED DRAFTING DEVICE FOR DRAWING PERSPECTIVES

[76] Inventor: John A. Mills, Rte. 2, Box 265-E, Bounts Creek, N.C. 27814

[21] Appl. No.: 515,819

[22] Filed: Aug. 16, 1995

[51] Int. Cl.[6] ..... B43L 13/14

[52] U.S. Cl. ..... 33/432; 33/434; 33/1 K

[58] Field of Search ..... 33/432, 1 K, 18.3, 33/20.3, 45, 434

[56] References Cited

U.S. PATENT DOCUMENTS

| | | | |
|---|---|---|---|
| 2,210,895 | 8/1940 | Brownjohn | 33/432 |
| 2,667,694 | 2/1954 | McQuaid, Sr. et al. | 33/432 |
| 3,389,470 | 6/1968 | Johnson | 33/434 |
| 3,464,117 | 9/1969 | Johnson | 33/434 |
| 4,403,423 | 9/1983 | Ford et al. | 33/432 |
| 4,453,318 | 6/1984 | Hayes | 33/432 |
| 4,918,822 | 4/1990 | Levitt | 33/432 |

*Primary Examiner*—Christopher W. Fulton

[57] ABSTRACT

A portable drafting device and learning tool for laying out perspective drawing lines to enhance the realism of standard 30 degree base line isometric drawings and other similar drawings with different base line angles. The device comprises a rectangular drawing board including a plurality of holes disposed linearly in the upper corner portions thereof for pivotally mounting a plurality of articulated arm members in functional relationship with the drawing surface. The articulated arms comprise upper arm portions which are pivotally coupled to straight-edge members, each being disposed at approximately thirty degrees to horizontal. Upper arm portions are provided with a plurality of adjustment holes for alternate placement of pivot pins, or a slot to effect vertical adjustment of the articulated arms in relation to the drawing surface. Straight-edge members may be pivoted at varying angles in relation to upper arm members to enable selective adjustment of the desired vanishing point distance. The drafting apparatus includes a set of perspective scalers which are selectively utilized as measurement guides for adding perspective enhancement to the vertical and horizontal features of the drawings. The invention is of particular benefit to the student draftsperson or artist who does not possess the skill necessary to produce precise perspective drawings.

10 Claims, 3 Drawing Sheets

ARTICULATED DRAFTING DEVICE FOR DRAWING PERSPECTIVES

FIELD OF INVENTION

This invention relates to drafting instruments and more particularly to a drafting device for drawing perspective lines which originate from a common vanishing point that lies at a remote distance from the drawing surface.

1. Background of Invention

Many prior art drafting instruments have been developed to provide a convenient means for producing perfect perspective drawings, without the need to physically establish a vanishing point, when the distance from the desired vanishing point to the drawing surface is too remote to be reached by any practical, physical means. Prior straight-edged devices require complex apparatus and limit both vanishing point location and drawing size.

Other known prior art devices utilize partial curves or curves added together, but this technique also limits the location of the vanishing point and requires extensive mathematical computation to determine the correct curve placement with respect to the intended perspective drawing. None of the prior art devices offers both professionals and students alike the versatility and extensive results possible with the drafting device disclosed herein.

2. Concise Explanation of Prior Art

U.S. Pat. No. 2,210,895 to Earl Brownjohn discloses a drawing apparatus with arms that are pivotally mounted to the upper portions of a drafting board. However, this device does not disclose the adjustable articulated secondary arms of the present invention.

U.S. Pat. No. 2,556,620 to Richard J. Hegner discloses a drafting apparatus having a frame provided with a pair of parallel guide tracks, a pair of arms each having a straight edge that is pivotally adjustable on a guide track positioning the arm at various locations.

U.S. Pat. No. 4,453,318 to Jess W. Hayes discloses an apparatus for use in conjunction with a drafting table for producing perspective drawings within a working area centered on the table.

U.S. Pat. No. 2,981,004 to George E. Edlund discloses a draftsman's perspective instrument for laying out perspective drawings.

U.S. Pat. No. 4,565,016 to Ronald T. Horbinski discloses a drafting instrument provided for drawing perspective lines without physically pre-establishing and marking a vanishing point.

U.S. Pat. No. 4,672,749 to Vladimir F. Tamari discloses a mechanical perspective drafting device capable of converting a ground plan of a given three-dimensional structure into a correct perspective drawing.

U.S. Pat. No. 2,667,694 to Dan J. McQuaid Sr., et al. discloses a perspective drawing machine adaptable to the making of perspective drawings directly, rather than from orthographic projections by means of linkage arrangements.

Finally, U.S. Pat. No. 3,868,777 to Franklin D. Bell discloses a perspective line generator or drafting instrument to aid in preparing accurate perspective views of objects using a small drawing surface where the vanishing points are too remote for the drawing surface to achieve the same by conventional techniques with a T-square or straight edge.

SUMMARY OF INVENTION

After much research and study into the above mentioned problems, the present invention has been developed to provide a means for draftspersons to increase the realism of isometric drawings by adding vanishing points to standard thirty degree isometric base lines. The present invention is particularly useful when the distance from the desired vanishing point to the drawing surface is too remote to be reached by any practical means.

The above is accomplished through the provision of a portable drafting device including a pair of articulated arms being pivotally mounted in the upper corner portions thereof. Each articulating arm includes a straight-edge member that is pivotally attached to said articulated arm at its terminal end. The pair of straight-edge members are adapted to have inner end portions overlying the surface of the drawing board at a location generally defining the customary thirty degree base line of an isometric drawing.

In this configuration the straight-edge members are readily adjustable to any desired angle relative to the drawing sheet and may be utilized to add perspective enhancement and realism while still retaining the basic thirty degree isometric base lines.

The present invention is also provided with a plurality of perspective scalers for providing vertical and horizontal perspective enhancement to conventional isometric or other similar drawings. Artists often term this foreshortening. The perspective scalers are provided with different sets of graduations related to the physical size of the drawing and the degree of detail desired.

The present invention is of particular benefit to the elementary and high school drafting or art student who does not possess the skill and knowledge necessary to produce precise and realistic three-dimensional drawings especially in classrooms where there is limited drawing board space available.

The present invention will also be of significant use to the experienced draftsperson or designer who does not rely on the traditional methods to physically determine placement of vanishing points, measuring lines, and the like.

In view of the above, it is an object of the present invention to provide a portable drawing board means for draftspersons to enhance the realism of conventional isometric drawings or other similar drawings having base angles other than 30 degrees by enabling the drawing of numerous parallel lines in perspective from vanishing points remote from the drawing surface. The draftsperson may select right and left vanishing points and selectively adjust the vanishing point distance as desired.

Another object of the present invention is to provide a set of perspective scalers to be used in conjunction with the portable drawing board means for obtaining vertical and horizontal perspective enhancement. The set of scalers are provided with different graduations thereon and are selected based on the size of the object to be drawn, the skill of the draftsperson and the degree of accuracy desired.

Another object of the present invention is to provide a portable drafting device which is adapted for use with standard thirty degree base lines of isometric drawings. Thus, the present invention enables the use of standard thirty degree triangles, thirty degree ellipse templates, and other standard drafting implements without special adaptation.

Another object of the present invention is to provide a simple and inexpensive teaching aid that may be utilized by beginning drafting and art students for learning perspective drawing.

Another object of the present invention is to provide a portable drafting device for the more experienced designer or artist who does not rely on the traditional methods to physically determine placement of vanishing points, especially if drawing space is limited, when it is necessary to draw numerous parallel lines in perspective.

Other objects and advantages of the present invention will become apparent and obvious from a study of the following description and the accompanying drawings which are merely illustrative of such invention.

DESCRIPTION OF PREFERRED EMBODIMENT

Figure 1:
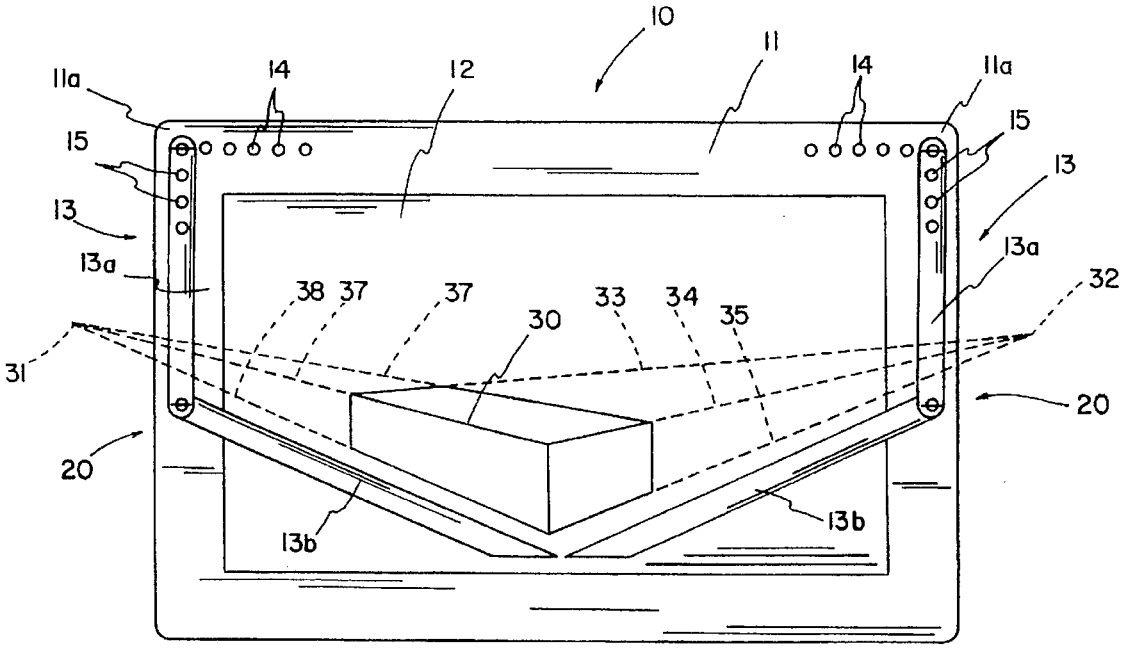
FIG. 1 is a plan view of the articulated arm drafting device of the present invention showing a pair of straight-edge members pivotally attached to the articulating arms and how a perspective drawing is made therefrom.

With further reference to the drawings, the articulated arm drafting device in accordance with the present invention, indicated generally at 10, is illustrated in FIG. 1.

In the preferred embodiment drafting board 11 is fabricated from ⅛ inch thick hardboard or other suitable material and measures 24 inches long by 18 inches wide generally conforming to the size of a student desk. However, the present invention can be adapted to much larger drawing surfaces such as a classroom blackboard if desired.

As previously noted, the device consists of a generally rectangular, portable drafting board 11 whereon a sheet of drawing paper 12 is secured in alignment thereto.

FIG. 1 shows therein a box 30 drawn on paper 12 in perspective from left and right vanishing points as indicated at 31 and 32.

Perspective drawing lines 33–35 right vanishing point 32 and form designated sides of box 30. Lines 33–35 radiate from common point 32 as a vanishing point and are substantially parallel in perspective Perspective drawing lines 36–38 are drawn from a common left vanishing point 31 and form other designated sides of box 30. Lines 36–38 radiate from common point 31 as a vanishing point and are substantially parallel in perspective.

As shown in FIG. 1, drafting device 10 is provided with a pair of articulated arms, indicated generally at 13 which are pivotally mounted at their proximal ends to the upper corner portions 11*a* of drafting board 11. Each respective articulated arm 13 includes an upper arm portion 13*a*, which is pivotally attached to a straight-edge member 13*b* at a terminal portion thereof.

Still referring to FIG. 1, there is shown therein a plurality of arm locating holes 14 positioned at regular intervals about the periphery of upper corner portions 11*a* of drafting board 11 in parallel, spaced-apart relation thereto.

Figure 8:
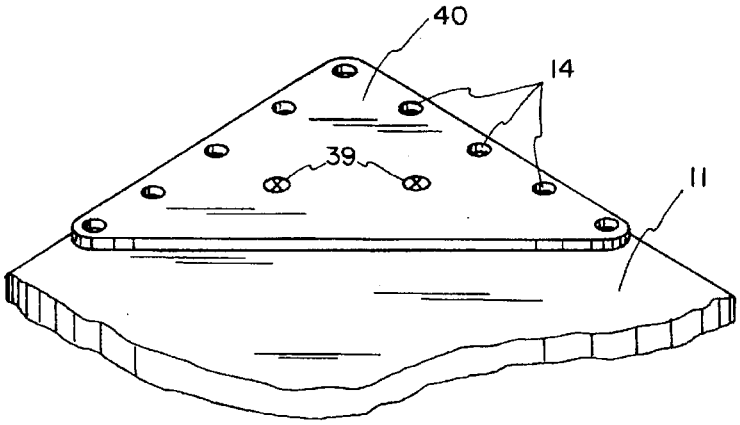
FIG. 8 is an enlarged perspective view of an alternative embodiment of the drafting device showing an arm locating bracket positioned on the upper right corner of the drafting board.

In an alternative embodiment shown in FIG. 8, arm locating holes 14 may be positioned within a pair of arm locating brackets 40, which are fixedly attached to the upper corner positions 11*a* of drafting board 11 by screws 39 or other suitable fasteners.

This alternative embodiment also permits the articulated arms 13 of the present invention to be adapted to pre-existing drawing boards and to other drawing surfaces such as classroom blackboards.

Similarly, each upper arm portion 13*a* is provided with a plurality of pivot pin locating holes 15 positioned at regular intervals and originating from a proximal end of upper arm portion 13*a*. Pivot pin locating holes 15 are adapted to receive a pivot pin 16 which is inserted therein and fixedly attached thereto as more clearly shown in FIG. 2.

Figure 2:
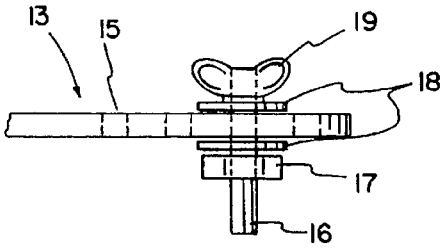
FIG. 2 is a side elevational view of an upper arm portion of an articulated arm of the present invention showing a detailed view of a pivot pin.

In the preferred embodiment pivot pin 16 is threaded at one end and includes a nut 17 threadably attached thereto. Pivot pin 16 is inserted through a selected pivot pin locating hole 15 such that a pair of washers 18 are disposed on either side of arm 13 and are secured in contact therewith by wing nut 19 as shown in FIG. 2.

Fixedly attached to arm 13, pivot pin 16 is inserted into a selected arm locating hole 14 being sized to a slip-fit condition whereby pivoting movement is imparted to arms 13 in a plane parallel to the surface of drafting board 11. It will be appreciated that straight-edge members 13*b* may be moved to alternate positions on drawing board 11 for laying out numerous parallel lines in perspective radiating from a common vanishing point as illustrated in FIG. 1.

In this manner arms 13 may be adjusted in either horizontal or vertical direction on drafting board 11 by selecting alternate arm locating holes 14 at the discretion of the draftsperson.

Referring again to FIG. 1 it can be seen that arm 13 is provided with an elbow joint, indicated generally at 20, formed at the juncture of the terminal end of upper arm portion 13*a* and the proximal end of straight-edge member 13*b*. Elbow joint 20 is provided with adjustable means, indicated generally at 28, for pivotally attaching and locking in position upper arm portion 13*a* and straight-edge member 13*b* at the desired angle for selective adjustment of the vanishing point distance.

Figure 3:
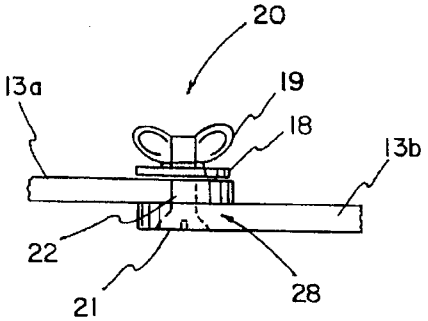
FIG. 3 is a side elevational view of the elbow joint of the present invention showing a distal end of an upper arm portion pivotally attached to a proximal end of a straight-edge member.

As more clearly shown in FIG. 3, upper arm portion 13*a* and straight-edge member 13*b* are attached by adjustable means 28 including a threaded bolt 21 which loosely penetrates a pair of pivot holes 22 located in the ends of upper arm section 13*a* and straight-edge member 13*b*. Bolt 21 is provided with a wing nut 19 which secures a washer 18 therebetween locking the respective ann portions in the desired angular relationship.

Figure 4:
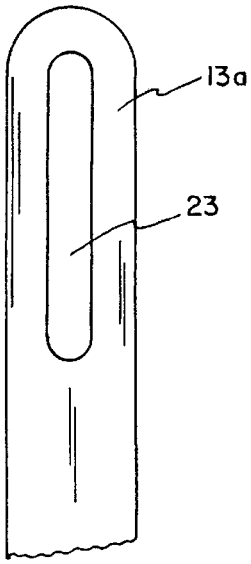
FIG. 4 is a plan view of an alternative embodiment of an upper arm portion of an articulated arm showing an elongated slot.

As can be seen in FIG. 4 in an alternative embodiment of the present invention, upper ann portions 13*a* and 24 may be provided with an elongated slot 23 at a proximal end in lieu of a plurality of pivot pin locating holes 15 to facilitate rapid up or down movement of pivot pin 16 in slot 23 as desired by the draftsperson. In this manner continuous vertical adjustment of arm 13 may be accomplished, which may be preferable in specific drawing situations.

Figure 5:
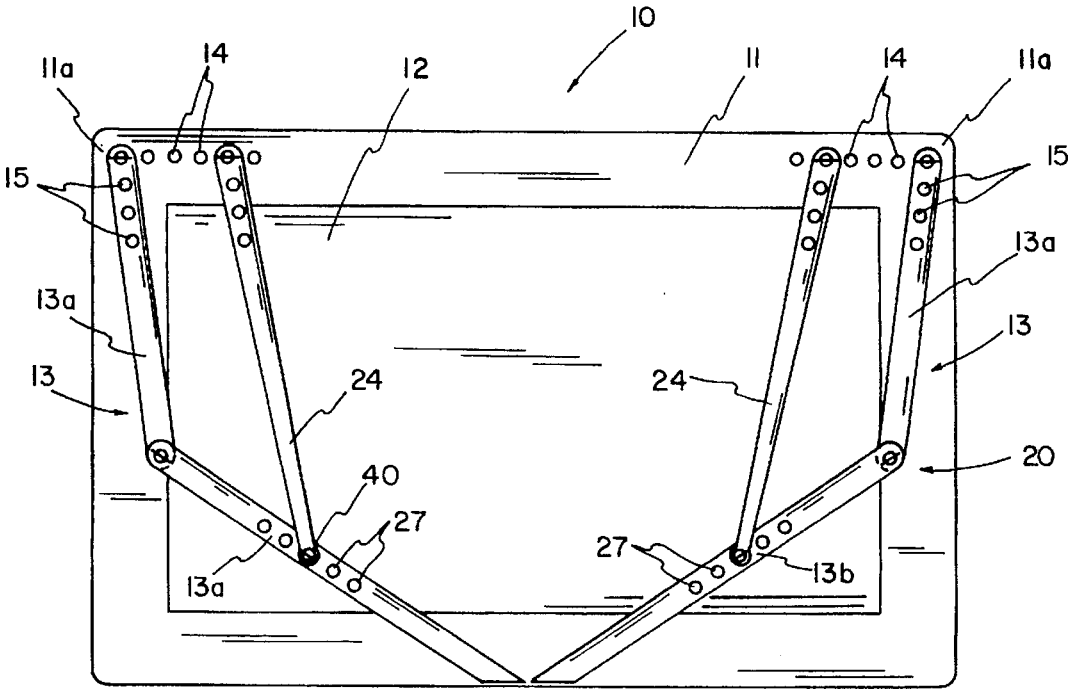
FIG. 5 is a plan view of an alternative embodiment of the drafting device showing a pair of upper arm portions pivotally attached to each straight-edge member.

Turning now to FIG. 5, there is shown therein an alternative embodiment of the articulated drafting device 10 of the present invention. It can be seen that in this embodiment an additional pair of secondary upper arm portions 24 are attached in pivoting relation to straight-edge members **13*b* at a point thereon that is approximately one-third of the distance from the proximal end to the distal end thereof as shown in FIG. 5. Secondary upper arm portions 24 are pivotally attached at their proximal ends by pivot pins 16 in the manner described hereinabove for upper arm portions 13*a***.

Similarly, the terminal ends of secondary upper arm portions 24 are pivotally attached at the aforementioned one-third point on straight-edge members **13*b* in the manner described hereinabove for elbow joint 20 and illustrated in FIG. 3**.

Figure 6:
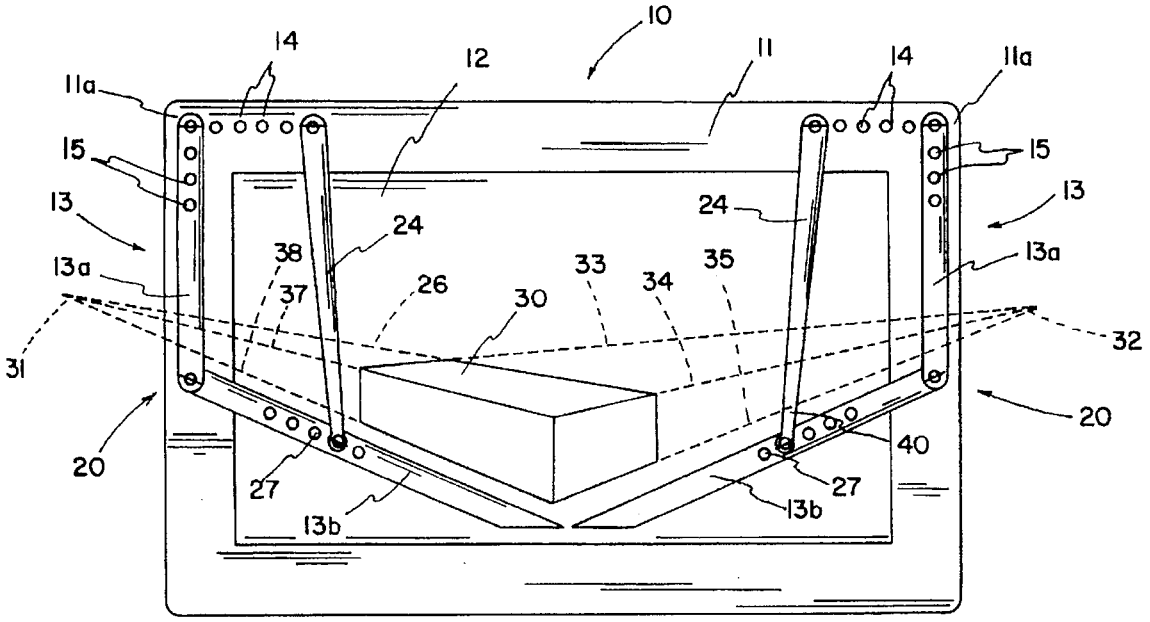
FIG. 6 is a plan view of the alternative embodiment of FIG. 5 showing how a perspective drawing is made therefrom.

In the embodiment shown in FIGS. 5 and 6, straight-edge members **13*b* are provided with a plurality of adjustment apertures 27 being generally positioned at the aforementioned one-third point at regular intervals to provide for alternate placement of adjustable means 28** therethrough.

It can be seen in FIG. 5 that the terminal portions of secondary upper arm portions are narrowed as at 40 to provide convenient access and visibility to that portion of a line being drawn thereunder.

In the operation of the embodiment illustrated in FIG. 6 it will be appreciated that device 10 provides both right and left vanishing points as in the previous embodiment shown in FIG. 1. However, the double-armed device of FIG. 5 enables the draftsperson to selectively adjust a desired vanishing point to a more remote distance from the periphery of the drawing board than with the single upper ann device previously described herein and shown in FIG. 1. The more remote vanishing point distance results from an increase in the radius of the arc scribed by the pivoting movement of the double armed device illustrated in FIG. 5.

Thus, the double-armed device depicted in FIG. 5 provides an improved level of versatility and perspective realism over the basic single arm device 10 depicted in FIG. 1.

Each of the alternative embodiments of the articulated arm device 10 of the present invention may be used in conjunction with perspective scalers 25 that can be utilized to enhance the vertical and horizontal perspective realism of the drawing. Each vertical scaler 25 includes graduation indicia 26, representing linear units of decreasing length.

Figure 7:
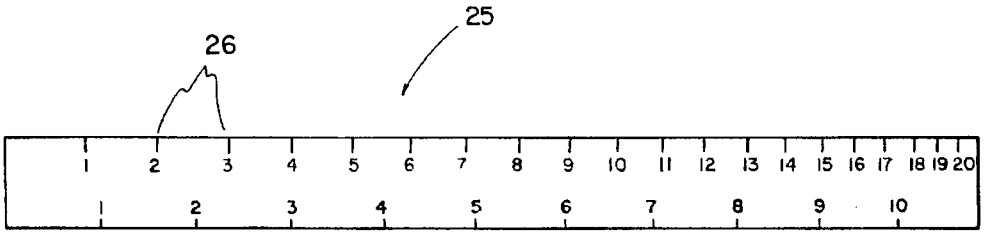
FIG. 7 is a plan view of a simple perspective scaler for beginners to be used in conjunction with the drafting device of the present invention showing different sets of graduation indicia.

It will be appreciated by referring to FIG. 7 that the linear distance between each graduation on scaler 25 decreases as the number representing each indicia 26 increases. The perspective scalers 25 provide the draftsperson with a measurement guide for drawing objects which appear close and distant simultaneously. Artists often term this foreshortening.

The appropriate scaler 25 is selected based upon the size of the object in the drawing. Thus, a sky scraper drawing ten inches high would require more vertical perspective than would a box ten inches high and an appropriate scaler 25 would be selected by the draftsperson depending upon usage, accuracy desired, and the skill of the draftsperson.

In addition to their use as a measurement guide for enhancing vertical and horizontal perspective, scalers 25 are adapted for use with straight-edge members **13*b*** as a straight-edge extension when needed.

From the above it can be seen that the present invention provides a relatively simple and inexpensive portable drafting device which enables the draftsperson to visually enhance a standard isometric drawing or a similar drawing having a different base line angle by laying out perspective drawing lines which radiate from vanishing points beyond the surface of the drawing board. The device of the present invention provides both right and left vanishing points as desired including selective adjustment of the desired vanishing point distance from the drawing board.

Further, the present invention provides a set of perspective scalers for use in conjunction with the drafting device as measurement guides to improve both vertical and horizontal perspective realism.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A portable drafting device for drawing perspective lines which originate from a common vanishing point that lies outside the periphery of the drawing surface comprising:

a generally rectangular drawing board having a plurality of arm locating holes located in the upper corner portions thereof, said holes being disposed linearly in both horizontal and vertical directions at regular intervals in parallel, spaced-apart relation to the periphery of said upper corner portions of said drawing board; and a plurality of articulated arm means, each respective articulated arm means including a primary upper arm member and a straight-edge member, said straight-edge member being provided with a terminal end having a thirty degree angle formed thereon to facilitate visual alignment of said straight-edge member to a standard thirty degree baseline, said primary upper arm member being pivotally coupled at a terminal end to a proximal end of said straight-edge member by adjustable means, said primary upper arm member being pivotally mounted in said holes by pivoting means enabling said straight-edge members to be disposed in a functional relationship with the surface of said drawing board for laying out perspective drawing lines and for selective adjustment of desired vanishing points.

2. The drafting device of claim 1 wherein said primary upper arm member is provided with a plurality of pivot pin locating holes disposed linearly at regular intervals on the center line of the proximal end thereof to enable vertical adjustment of said arm member in relation to said drawing board.

3. The drafting device of claim 1 wherein said primary upper arm member is provided with an elongated slot disposed on the center line of the proximal end thereof to provide for continuous vertical adjustment of said arm member in relation to said drawing board.

4. The drafting device of claim 1 wherein said arm locating holes are disposed within a pair of arm locating brackets, each of said brackets being fixedly attached to a respective upper corner of said drawing board whereby said articulated arm means may be pivotally mounted on said brackets in functional relation to said drawing board.

5. A portable drafting device for drawing perspective lines which originate from a common vanishing point that lies outside the periphery of the drawing surface at a remote distance comprising:

a generally rectangular drawing board having a plurality of pivot pin locating holes positioned in the upper corner portions thereof, said holes being disposed linearly in both horizontal and vertical directions at regular intervals in parallel, spaced-apart relation about the periphery of said upper corner portions; and a plurality of articulated arm means, each respective articulated arm means including a primary upper arm member, a secondary upper arm member, and a straight-edge member, said primary upper arm member being pivotally coupled at a terminal end thereof to a proximal end of said straight-edge member, said secondary upper arm member being pivotally coupled at a terminal end thereof to a point on said straight-edge member that is approximately one-third of the distance from said proximal end to a distal end thereof by adjustable means, said primary and said secondary upper members respectively being pivotally mounted in said holes by pivoting means whereby selective adjustment of a desired vanishing point at a remote distance from the periphery of said drawing board may be obtained.

6. The drafting device of claim 5 wherein said straight-edge members are provided with a terminal end having a thirty degree angle formed thereon whereby said straight-edge members may be visually aligned to a standard thirty degree base line.

7. The drafting device of claim 6 wherein said straight-edge members are provided with a plurality of adjustment apertures arranged linearly at regular intervals on the center line of said straight-edge members at the approximate mid-point of the same and being offset toward a proximal end thereof.

8. The drafting device of claim 7 wherein said primary upper arm member and said secondary upper arm member are each respectively provided with a plurality of pivot pin locating holes disposed linearly at regular intervals on the center line of said arm members at a proximal end thereof to provide for vertical adjustment of said arm members in relation to said drawing board.

9. The drafting device of claim 7 wherein said primary upper arm member and said secondary upper arm member are each provided with an elongated slot disposed on the center line of said arm members at the proximal ends thereof to provide for continuous vertical adjustment of said arm members in relation to said drawing board.

10. The drafting device of claim 7 wherein said arm locating holes are disposed within a pair of arm locating brackets, each of said brackets being fixedly attached to a respective upper corner of said drawing board whereby said articulated arm means may be pivotally mounted on said brackets in functional relation to said drawing board.

* * * * *